US006027115A

United States Patent [19]

Griswold et al.

[11] Patent Number: 6,027,115

[45] Date of Patent: Feb. 22, 2000

[54] SLOT MACHINE REELS HAVING LUMINESCENT DISPLAY ELEMENTS

[75] Inventors: Chauncey W. Griswold; Robert A. Luciano, Jr., both of Reno; Harold E. Mattice, Gardnerville; Boone McReynolds, Reno; Richard D. Sadler, Carson City, all of Nev.

[73] Assignee: International Game Technology, Reno, Nev.

[21] Appl. No.: 09/047,889

[22] Filed: Mar. 25, 1998

[51] Int. Cl.[7] ..... G07F 17/34

[52] U.S. Cl. ..... 273/143 R; 463/20; 463/31

[58] Field of Search ..... 273/143 R, 138 A, 273/138.2, 138.1; 463/20, 31

[56] References Cited

U.S. PATENT DOCUMENTS 5,580,055 12/1996 Hagiwara ..... 273/143 R

FOREIGN PATENT DOCUMENTS 2092795 8/1982 United Kingdom ..... 273/143 R
2116345 9/1983 United Kingdom ..... 273/143 R
2253299 9/1992 United Kingdom ..... 273/138 A

OTHER PUBLICATIONS

Display of "High Rollers Triple Diamond" Gaming Machine at a casino in Nevada in about 1995 (photograph of similar machine).

Brochure describing "Electroluminescent Display" available from Planar Corporation, prior to Jan. 1997 (3 pages).

*Primary Examiner*—Benjamin H. Layno
*Attorney, Agent, or Firm*—Beyer & Weaver, LLP

[57] ABSTRACT

Slot machines having reels in which the symbol regions contain electroluminescent elements are disclosed. The electroluminescent elements define one or more reel symbols such as cherries, bars, a number "7", etc. In some embodiments, multiple electroluminescent elements are provided in each symbol region. This allows a given symbol to be displayed in multiple formats, with each format representing a different item. For example, a "7" could be displayed with its outline illuminated, with interior cross hatching illuminated, with a combination of the cross hatching and outline illuminated, or with different colors. The permutations can be increased if the symbol regions contains inked images in addition to the light elements. In such cases, when all light elements are turned off, the inked symbol appears.

57 Claims, 8 Drawing Sheets

SLOT MACHINE REELS HAVING LUMINESCENT DISPLAY ELEMENTS

BACKGROUND OF THE INVENTION

The present invention is directed to gaming machines and more particularly to optical displays provided on spinning reels of slot machines.

Conventional slot machines employ spinning reels having multiple symbols on each reel. When a player initiates a play on a slot machine, each of the reels of the slot machine begins spinning. At some point, due to friction or electronic control, for example, the reels will come to rest with one or more symbols per reel displayed through a display window. Certain combinations of displayed symbols are designated as winning combinations. When a play concludes with a winning combination being displayed, a payout may be awarded to a player.

In traditional mechanical slot machines, each reel of a slot machine might have, for example, twenty-two stops or symbols which can be displayed as part of a multiple reel payline combination. The odds of any particular combination appearing is given by the product of the number of symbols on the first reel times the number of symbols on the second reel times a number of symbols on a third reel, etc. If there are twenty-two symbols on each reel of a three-reel slot machine, the odds of obtaining any given combination are twenty-two times twenty-two times twenty-two or one in ten thousand six hundred forty eight plays. Thus, the maximum jackpot payable by such slot machine is limited to the amount that could be paid one in every ten thousand six hundred forty eight plays (i.e., about $2,600 for a quarter slot machine).

While the payout opportunity afforded by conventional slot machines may be sufficiently exciting to many players, other players desire the opportunity to win a much larger jackpot. To make this possible, additional reels could be provided or additional symbols per reel could be provided. Unfortunately, neither of these solutions is acceptable. It has been observed that slot machines having four or more reels are less appealing to players. In addition, it is difficult to provide more than about 25 symbols per reel because the reel then becomes too large to fit within the physical dimensions of the standard-sized slot machine.

An alternative technique for increasing the jackpot size in slot games employs a "virtual reel." This technique is described in U.S. Pat. No. 4,448,419 (issued to Inge S. Telnaes and assigned to International Game Technology), which is incorporated herein by reference for all purposes. The virtual reel is actually a software program which randomly selects one symbol from a very large collection of possible symbols. For example, there may be one hundred twenty-eight different stops available on the virtual reel. That is, there may be a one in one hundred twenty-eight chance of obtaining a particular symbol on the virtual reel. During a play, a symbol is randomly selected from the virtual reel. At the same time, a physical reel is spinning and observable by a player through a display glass. The outcome of the software's random selection of a symbol is then assigned to one of a smaller number of stops on the physical reel. A control circuit then causes the spinning reel to stop at the symbol selected by the software. The software controls the outcome of the game and the physical reel merely acts as a display device, making higher odds possible and offering a much larger jackpot.

If there are only twenty-two stops on the physical reel and one hundred twenty-eight stops on the virtual reel, then multiple stops on the virtual reel must be assigned or correspond to a single stop on the physical reel. To reduce the odds of some symbol combinations, certain stops on the physical reel must be represented by fewer virtual positions than others on the virtual reel.

Most casino slot games produced today, including progressive games, employ virtual reels as described above. While such games have met some needs of the industry, alternative techniques for generating larger jackpots for slot games would be desirable.

SUMMARY OF THE INVENTION

The present invention provides slot machines having reels in which "symbol regions" (multiple symbol regions together make up a reel strip) contain light elements which define one or more actual symbols. For example, the light element might define a bar, a cherry, a number "7", etc. In some embodiments, multiple light elements are provided in each symbol region. This allows a given symbol to be displayed in multiple formats, with each format representing a different item. For example, a "7" could be displayed with its outline illuminated, with interior cross hatching illuminated, or with a combination of the cross hatching and outline illuminated. Similarly, a triple bar may be present at a particular position on the reel strip that can be illuminated to display a single bar, a double bar, or a triple bar. Thus, a single reel strip symbol region can display three different items. If a given reel has twenty-two symbol regions and each of those symbol regions can display three distinct symbols, the reel now has sixty-six symbols available in a stop reel.

The permutations can be increased if the symbol regions contain inked images in addition to the light elements. In such cases, when all light elements are turned off, the inked symbol appears. This provides one additional symbol item available for each symbol region. In order for this design to work, the light elements should preferably be transparent, so that when they are turned off, the ink symbol is visible through them. One suitable light source for this embodiment is an electroluminescent element.

Conventional reels are illuminated by providing an incandescent or fluorescent light behind the display portion of the reels. By employing light elements on the symbol regions of the reel strips, it may no longer be necessary to provide lighting with the reels. Thus, the normal maintenance associated with such lighting may be eliminated in slot machines employing the present invention.

Further, electroluminescent elements may be lit to clearly define a winning combination. This may not be a particularly pressing issue for slot machines having a single pay line. However, it is increasingly common to employ slot machines having multiple pay lines in which some winning combinations span multiple pay lines diagonally or through another arrangement. Very often, it is not immediately clear to the user what combination resulted in a win. By lighting the symbols comprising the winning combination, the present invention improves the player's cognizance of winning.

In one aspect, the present invention provides a reel for a slot machine. The reel may be characterized as including the following elements: (a) an internal reel portion rotatable about an axis and having an outer circumferential region and (b) a reel strip mounted on the outer circumferential region. The reel strip includes (i) a plurality of symbol regions for displaying symbols to a player of the slot machine and (ii) one or more light elements in one or more of the symbol regions, which light elements can be illuminated independently of one another. Preferably, the one or more light elements are electroluminescent elements.

In a preferred embodiment, the reel also includes a circuit element provided on the reel strip for independently controlling the two or more light elements. In one specific embodiment, the circuit element includes a high frequency AC switch for controlling at least one of the light elements. The high frequency switch may include a bridge having (i) a switching transistor which controls delivery of power to at least one of the light elements and (ii) a plurality of rectifying diodes arranged to force current flowing through the switching transistor to flow in a single direction through the switching transistor regardless of which direction the alternating current flows.

Another aspect of the invention provides a method of performing a game play on a gaming machine. The method may be characterized as including the following steps: (a) determining that a user has initiated the game play; (b) spinning a plurality of reels on the gaming machine; (c) illuminating a light element provided on at least a portion of a symbol on one of the reels; and (d) stopping the reels from spinning such that a combination of symbols is displayed through a display window of the gaming machine. When the reels stop, the illuminated light element will be displayed through the display window.

The step of illuminating may illuminate only a portion of the symbol or the entire symbol. If the light element is an electroluminescent element, the step of illuminating may involve delivering an AC current of frequency between about 600 and 900 Hz to the electroluminescent element.

When the gaming machine includes multiple pay lines, the step of illuminating may illuminate only those symbols displayed that comprise a winning combination. In some embodiments, a winning combination may require that a light element is lighted. Thus, a combination displaying the light element when it is not lit does not represent a winning combination.

Yet another aspect of the invention provides a reel strip for use as a display portion of a slot machine reel. Such reel strips may be characterized as including the following elements: (a) a flexible substrate; (b) a first electrode formed on the substrate; (c) one or more electroluminescent elements formed on at least a portion of the first electrode; and (d) a second electrode formed over at least the electroluminescent elements. At least one of the first and second electrodes should be transparent. Often a second substrate, including inked images of symbols, will be affixed to the second electrode.

Preferably, the transparent electrode is made from indium tin oxide. To better isolate the electroluminescent regions, they may be surrounded by non-luminescent dielectric regions. Together the electroluminescent regions and surrounding dielectric regions are sandwiched between the first and second electrodes. The reel strip may also include one or more circuit elements controlling application of power to at least portions of the first and second electrodes. In a preferred embodiment, these circuit elements are integrated circuits.

These and other features and advantages of the invention will be described in more detail below with reference to the associated drawings.

DETAILED DESCRIPTION OF THE PREFERRED EMBODIMENTS

Figure 1:
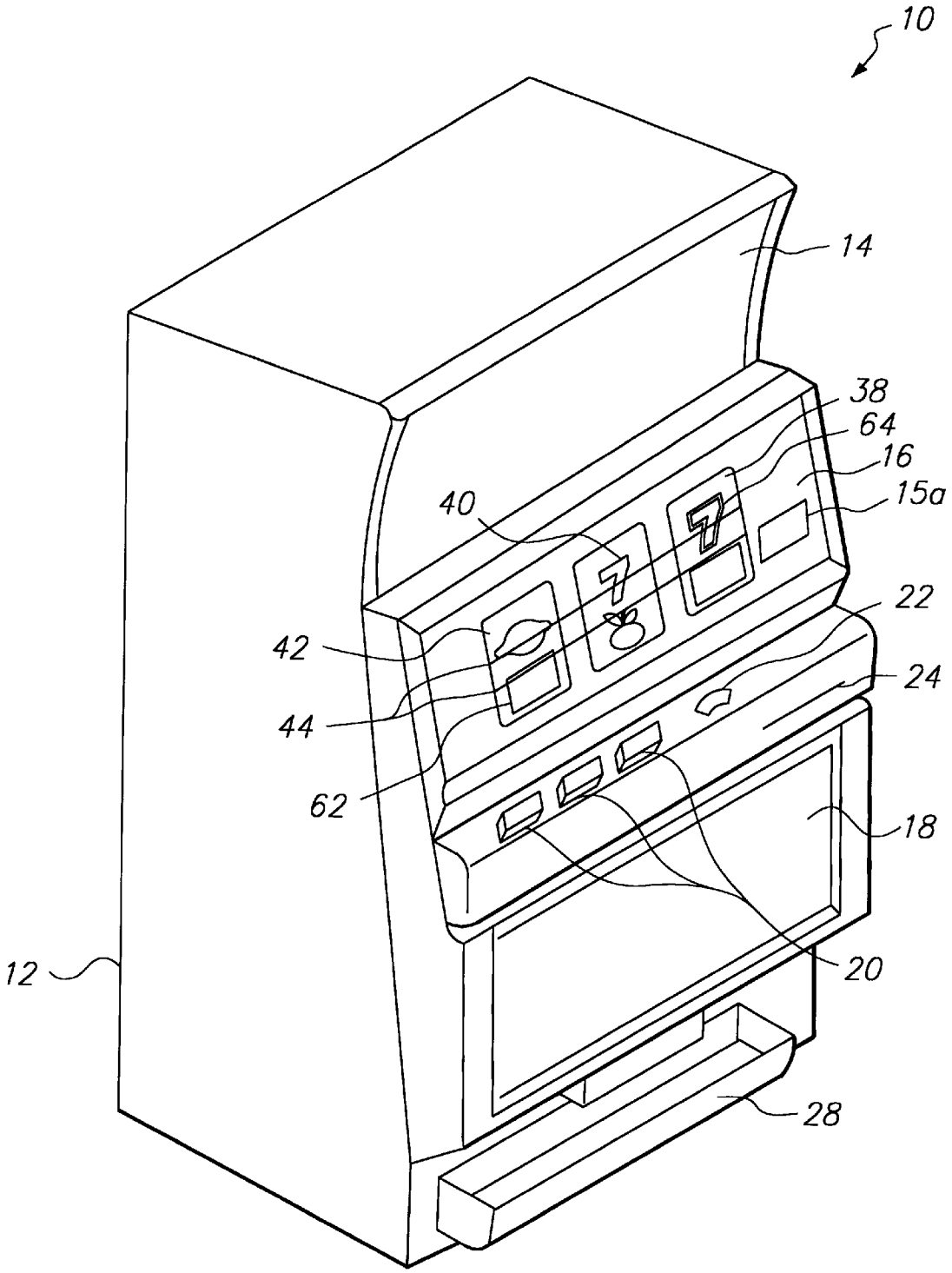
FIG. 1 presents a perspective view of a slot machine having electroluminescent reels in accordance with one aspect of the present invention.

Turning first to FIG. 1, a slot machine 10 suitable for use with the present invention is displayed. It includes a slot machine exterior housing 12 and a front face including a top glass 14, a main display 16, and a belly glass 18. Main display or reel glass 16 includes windows 38, 40, and 42 each of which display a single spinning reel of the slot machine. Horizontal pay lines 44 span the windows and allow for multiple winning combinations. Top glass 14 and belly glass 18 typically contain printed information conveying various thematic or instructive details about gaming machine 10. Glasses 14 and 18 are also typically backlit so that information printed on them is readily visible to gaming machine players. In addition, meter 15*a* within main display reel glass 16 presents primary game information such as coin insert events (e.g., a 7-segment LED meter will increase its count in region 15*a* in response to a player inserting a coin or a bill into bill acceptor 24). Player buttons 20 are provided between belly glass 18 and main display reel glass 16 and allow the player to control operation of gaming machine 10. A coin acceptor 22 and a bill acceptor 24 are provided near the play buttons as shown. Finally, a coin tray 28 is provided near the bottom of slot machine 10 to collect coin pay outs from winning plays.

As mentioned, reels are provided behind windows 38, 40, and 42. These reels include light elements which create an illuminated "bar" symbol 62 and an illuminated "7" symbol 64. Preferably, though not necessarily, elements 62 and 64 are electroluminescent elements.

Figure 2A:
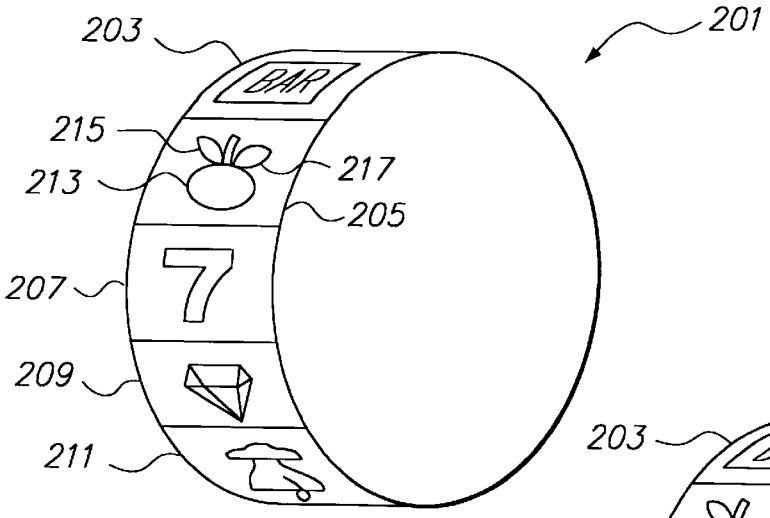
FIGS. 2A–2D are illustrations of a single electroluminescent reel at various stages of illumination and defining different symbols.

FIGS. 2A–2D represent a slot machine reel having light elements in various stages of illumination in accordance with an embodiment of the present invention. In FIG. 2A, a reel 201 is shown having separate symbol regions 203, 205, 207, 209, and 211. In symbol region 203, a bar symbol is displayed without illumination. In symbol region 205, a cherry symbol is displayed in a fully illuminated state. Note that illumination is indicated in FIGS. 2A–2D as thick outlines. In contrast, non-illuminated symbols are depicted with relatively thinner outlines. Symbol region 207 includes a numeral "7" with illumination along its outline. Symbol region 209 contains a diamond symbol without illumination and symbol region 211 shows a bell symbol without illumination.

Figure 2B:
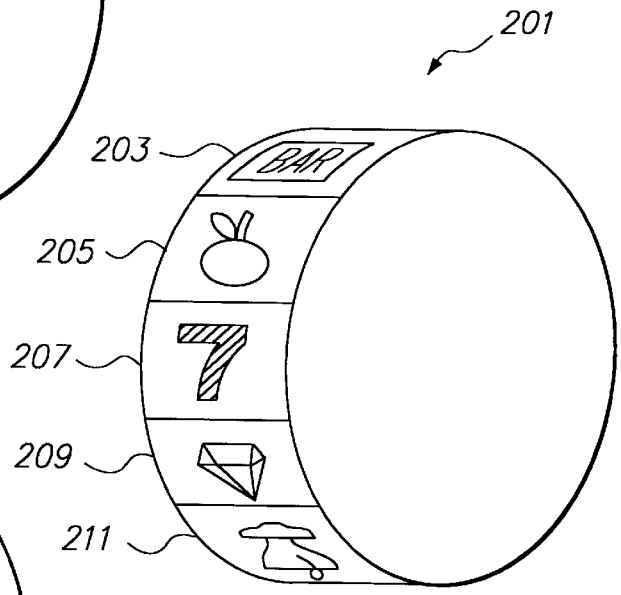

FIG. 2B presents slot machine reel 201 in a different state of illumination. In this state, the bar symbol in region 203 and the bell symbol in region 211 remain unchanged. That is, they remain unilluminated. The diamond symbol in region 209, however, has had its outline illuminated as indicated by the thicker lines surrounding it. The symbol items in regions 205 and 207 are also illuminated, but in a different format than shown in FIG. 2A. Specifically, the numeral "7" in region 207 has had its outline illumination turned off. Instead, it has had a cross-hatched illumination turned on. Further, the cherry symbol item in region 205 remains illuminated in a fruit portion 213 and one leaf portion 215. However, a second leaf portion 217 has been turned off so that the overall cherry outline is changed. Thus, symbol region 205 and 207 each have at least two light elements defining the symbols they display.

Figure 2C:
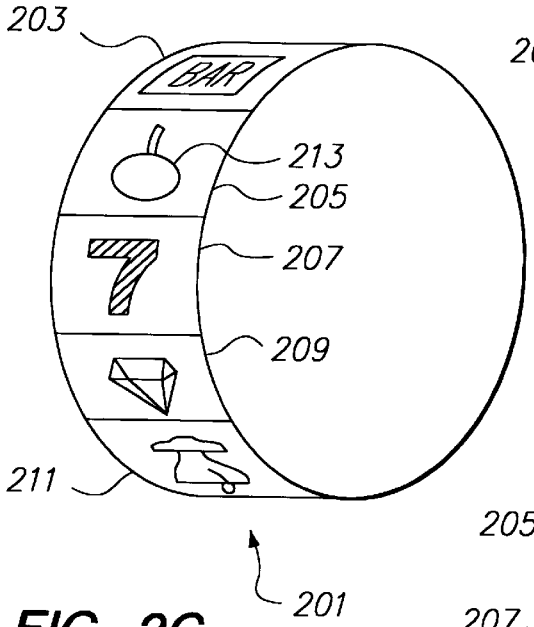

FIG. 2C presents slot machine reel 201 in yet a different state of illumination. In this state, the bar symbol in region 203 and the bell symbol in region 211 remain unilluminated. The illumination surrounding the diamond symbol in region 209 has now been turned off so that the diamond reverts to the state appearing in FIG. 2A. The "7" symbol in region 207 now is shown having both its outline and cross-hatching illuminating. Thus, the "7" symbol is shown in a third state of illumination. This is accomplished with only two separately controllable illumination regions: a cross-hatching region and an outline region. Finally, the cherry symbol in region 205 is shown with neither of its leaves illuminated in FIG. 2C. Only fruit portion 213 remains illuminated. As should be apparent, the cherry symbol includes three illumination regions: fruit region 213, left leaf 215, and right leaf 217.

Figure 2D:
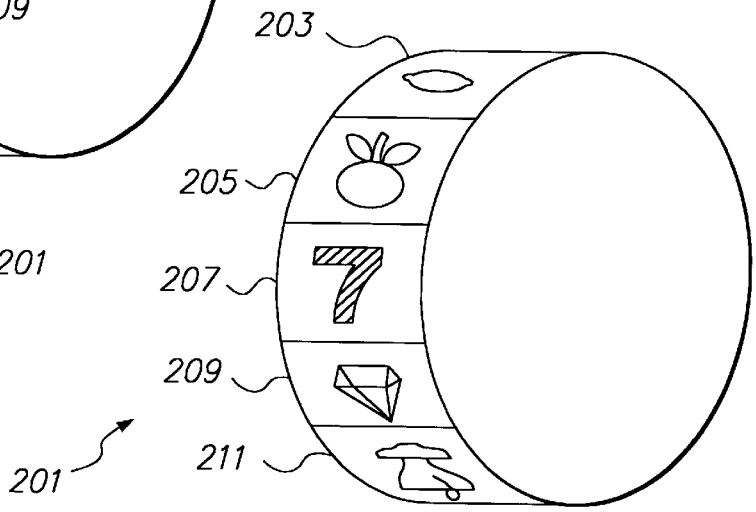

Finally, FIG. 2D presents slot machine reel 201 in a fourth state of illumination. In this state, the diamond in region 209 and the bell in region 211 remain unilluminated. The "7" symbol in region 207 remains fully illuminated. The cherry symbol in region 205 has been completely relit so that both the leaves and the fruit region are illuminated. Finally, the unilluminated bar in region 203 has been replaced by an illuminated lemon symbol. Note that the lemon symbol was always present, but unilluminated, in reel 201 during the states illustrated in FIGS. 2A–2C. When a circuit element instructs the illumination portion in region 203 to emit light, it does so in the form of a lemon which masks the appearance of the bar symbol which is provided in an "ink" form.

In one embodiment, the illumination medium (light element) presents the same symbol as an underlying ink symbol, but displays it in a different color. Further, a given symbol region may have multiple light elements each defining the same symbol or portion of a symbol, but having different colors. These embodiments allow payout combinations to be defined in whole or part by color.

Figure 3A:
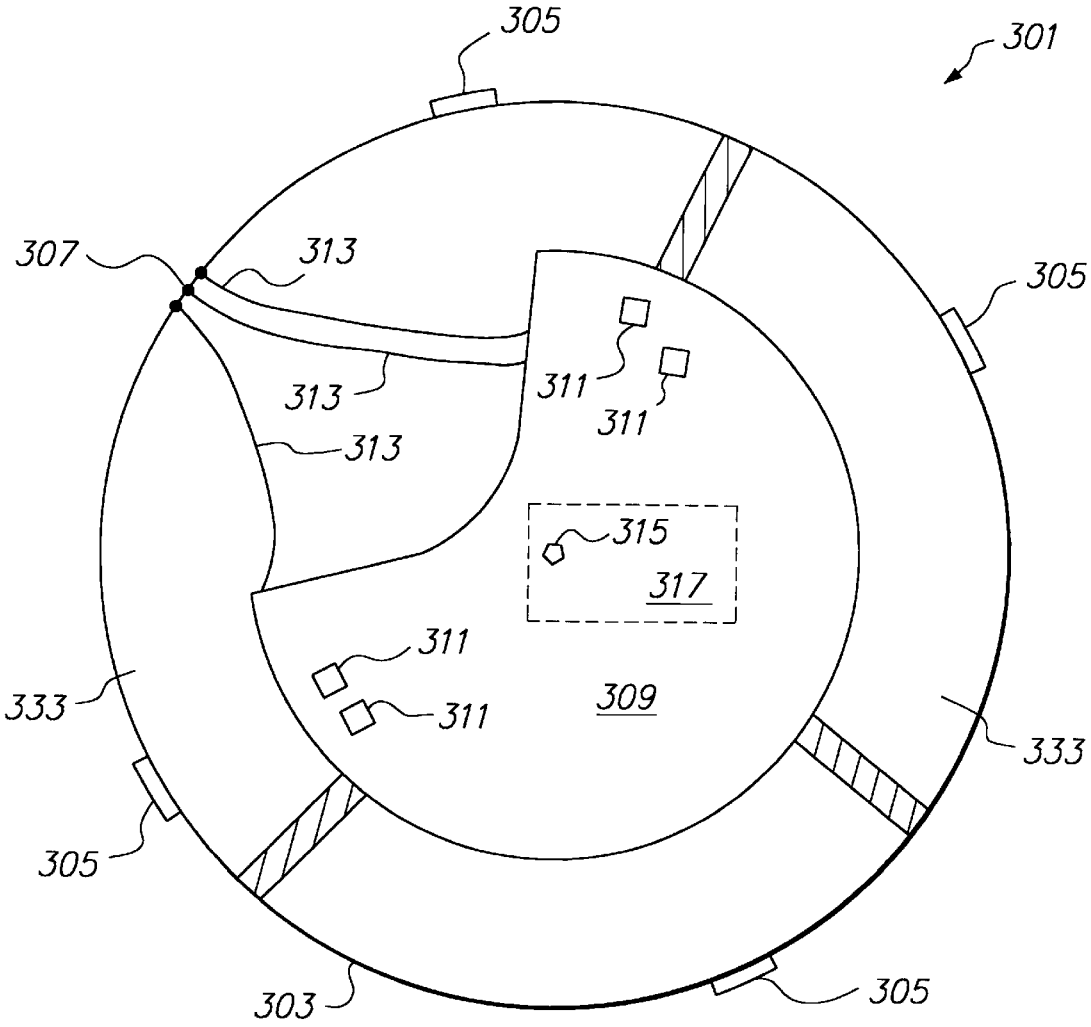
FIG. 3A is a side cross-sectional view of an electroluminescent reel and an associated printed circuit board in accordance with one embodiment of this invention.
Figure 3B:
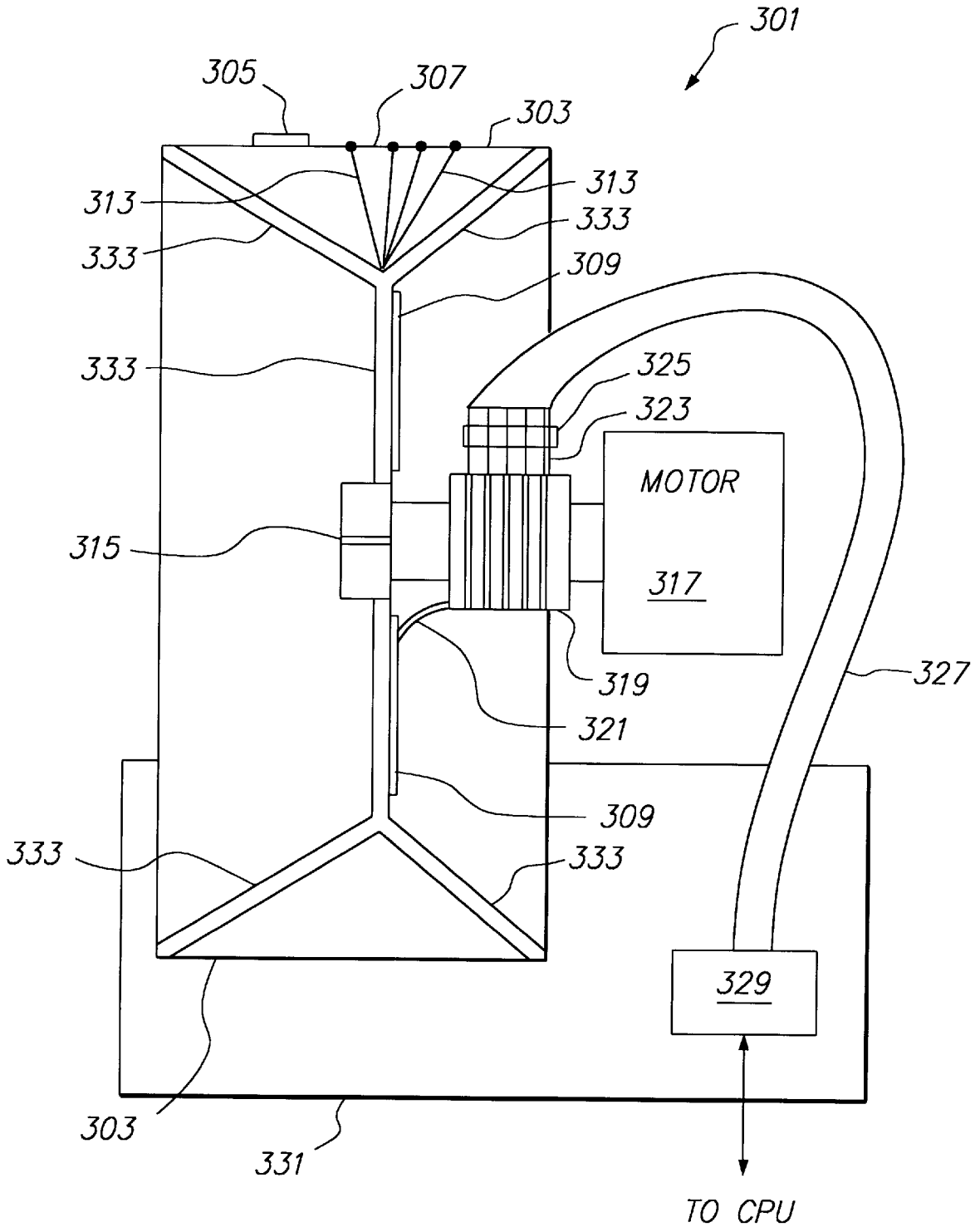
FIG. 3B is a front cross-sectional view of the electroluminescent reel of FIG. 3A together with a stepper motor and connections to an external power supply.

FIGS. 3A and 3B present cross sectional views of a slot machine reel in accordance with a preferred embodiment of this invention. Specifically, FIG. 3A shows a cross section perpendicular to the axis of rotation and FIG. 3B shows a cross section through the axis of rotation and perpendicular to the reel's radius. As shown in these figures, a reel 301 includes a reel strip 303 on the outer circumferential surface of an internal or supporting portion 333 of reel 301. Reel strip 303 includes various symbol regions containing slot machine symbols and associated light elements as discussed above. In addition, reel strip 303 optionally includes one or more integrated circuits 305 which process appropriate data to control illumination of the various light elements on the symbol regions. Electrical power and data is delivered to reel strip 303 via a reel strip connection 307.

A printed circuit board 309 mounted on the interior of reel 301 contains at least some of the circuitry necessary for controlling the light elements on reel strip 303. Printed circuit board 309 may include one or more integrated circuits 311 as shown. Control signals output from the circuitry on printed circuit board 309 is provided to reel strip connection 307 via a plurality of lines 313.

Specifically, FIG. 3B shows supporting portion 333 or reel 301 rotates about an axis of rotation 315 and is driven by a drive motor 317. Motor 317 also drives a slip ring drum 319 attached to axis of rotation 315. Slip ring drum 319 includes multiple contacts connected to circuitry on printed circuit board 309 by a cable 321. Thus, slip ring drum 319, cable 321 and printed circuit board 309 all rotate together about the axis of rotation. Control signals from outside the reel are provided to the spinning reel by brushes 323 mounted to a brush block 325. Signals to the brush block 325 are provided by a cable 327 which is mounted to a connector 329. Lines from connector 329 are provided to a central processing unit (not shown) which controls the game's outcome. In one specific embodiment, the central processing unit is a custom gaming machine CPU such as the 80960 microprocessor manufactured by Intel Corporation and used in gaming machines available from IGT of Reno, Nev. The entire reel mechanism is mounted on a stand 331.

Figure 4A:
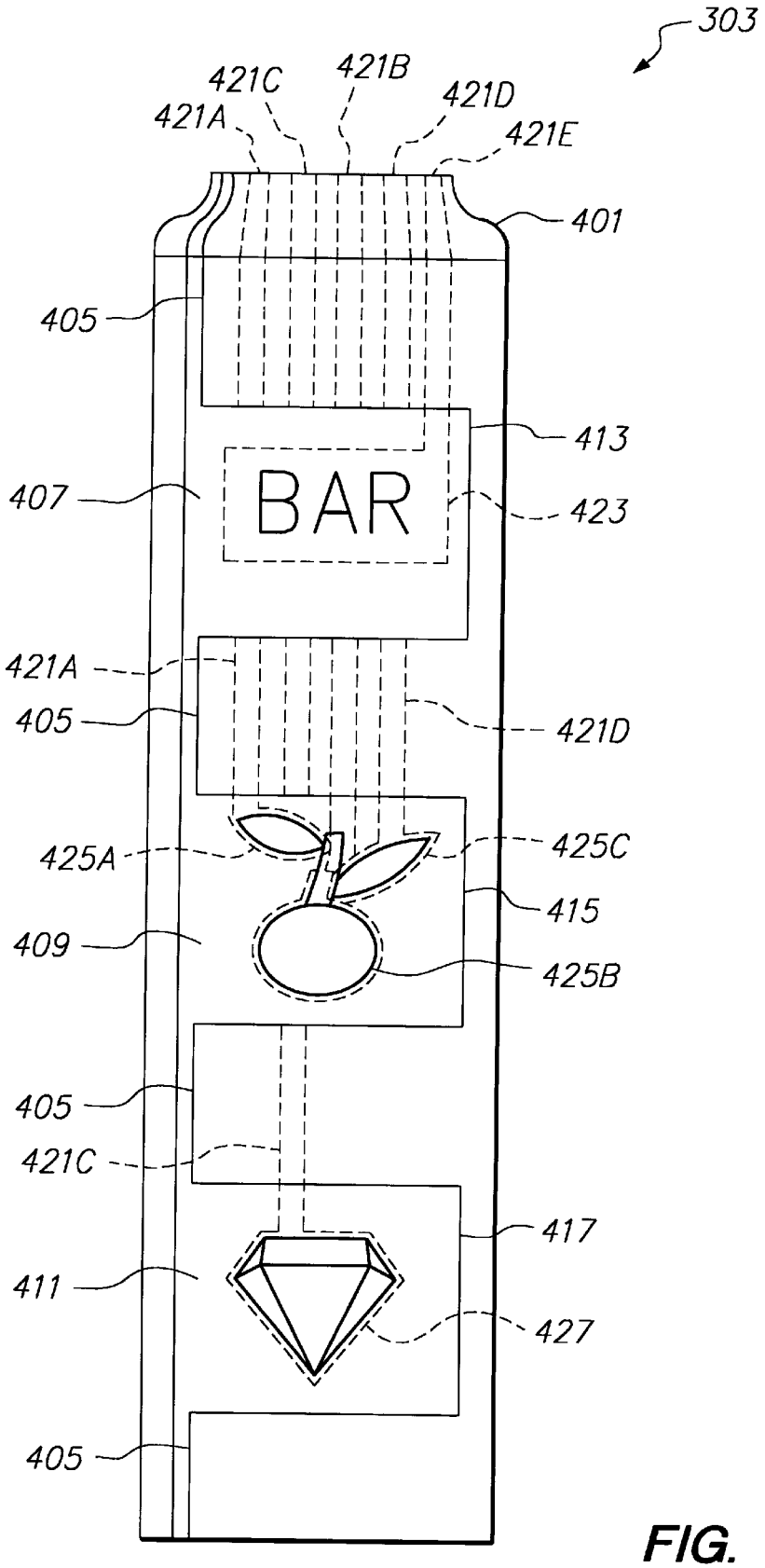
FIG. 4A is a top view of an electroluminescent reel strip in accordance with an embodiment of the present invention.
Figure 4B:
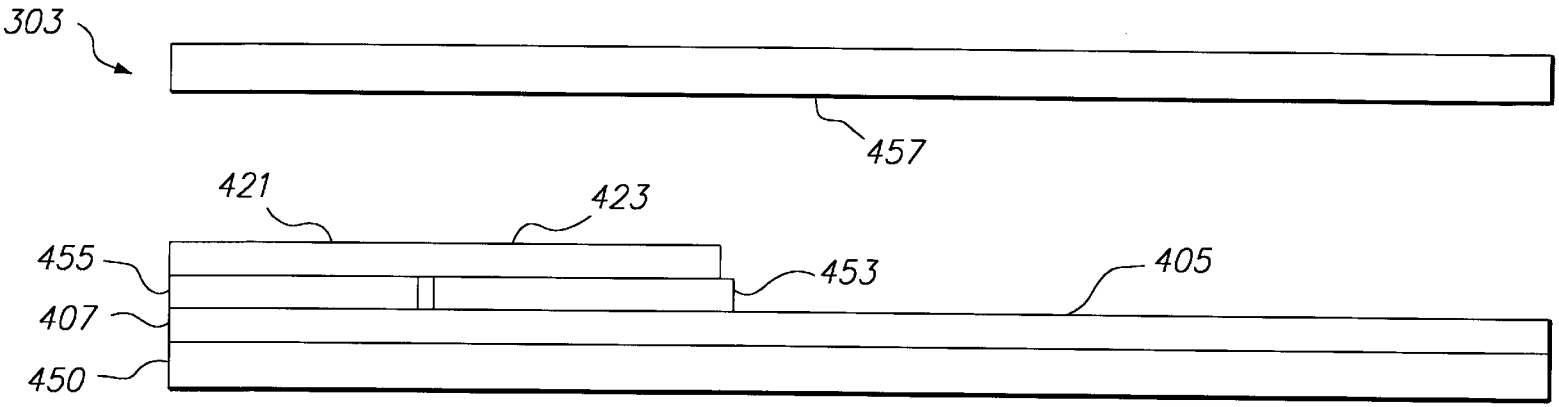
FIG. 4B is a side cross-sectional view of the electroluminescent reel strip of FIG. 4A.

FIGS. 4A and 4B depict a reel strip 303 in greater detail. FIG. 4A presents a view of reel strip 303 and showing three symbol regions 413, 415 and 417. In this embodiment, the individual light elements on the symbol regions of reel strip 303 are electroluminescent elements. Each electroluminescent element is defined by a capacitor having two "conductive" plates and an electroluminescent dielectric sandwiched therebetween. Each electroluminescent element in reel strip 303 must be independently controllable. Thus, separate lines are provided to at least one of the conductive plates of each such element.

In the embodiment depicted, one plate is provided by a continuous strip of conductive material. This strip includes trace segments 405 connecting individual conductive plates 407, 409 and 411 in adjacent symbol regions 413, 415, and 417. While not depicted in FIG. 4A, traces 405 would connect additional conductive plates distributed along the remaining length of reel strip 303.

To simplify the illustration, electroluminescent elements are not explicitly depicted in FIG. 4A. The electroluminescent material associated with the symbols in regions 413, 415, and 417 define the shape of the symbol items themselves. Thus for example in region 413, the electroluminescent dielectric element defines the bar symbol shown. Similarly, in region 415, the electroluminescent dielectric defines a cherry symbol and in region 417, the electroluminescent dielectric defines a diamond symbol.

The individual electroluminescent elements in the various symbol regions are independently controlled by separate traces 421A–E. Each of these traces terminates in a conductive plate associated with the electroluminescent element it controls. For example, trace 421E terminates in a conductive plate 423 which controls illumination of the bar symbol in region 413.

In region 415, three separate traces, 421A, 421B, and 421D control illumination of three separate electroluminescent elements comprising the cherry symbol. As shown, trace 421A terminates in a conductive plate 425A which illuminates a left leaf of the cherry symbol. Conductive trace 421B terminates in a conductive plate 425B which controls illumination of an electroluminescent element controlling the fruit portion of the cherry symbol. Finally, conductive trace 421D terminates in a conductive plate 425C which controls illumination of the right leaf of the cherry symbol.

Conductive trace 421C terminates in a capacitor plate 427 which controls illumination of the diamond symbol in region 417. Preferably, the conductive traces 421 and the capacitor plates that they terminate in are made from a conductive yet transparent material. One such material is indium tin oxide.

FIG. 4B presents a cross-sectional view of reel strip 303. As shown, strip 303 includes a polymeric substrate 450 made from a flexible material such as polyester. A conductive layer such as aluminum is formed on substrate 450. This layer is patterned to comprise traces 405 and lower capacitor plates such as plate 407. Next, an isolation layer 455 is formed over substrate 450 including traces 405 and capacitor plate 407. Isolation layer 455 is then patterned to define electroluminescent regions. Within these regions, electroluminescent dielectric elements such as element 453 are formed. On top of this structure, traces 421 and capacitor plates such as plate 423 are formed. Again, this material is preferably a transparent conductor such as indium tin oxide. This layer should be transparent so that light generated from electroluminescent elements such as element 453 will be visible to the slot machine player.

The entire electroluminescent capacitor structure described until now is covered with a printed cover strip 457. This cover strip should be transparent except where inked symbol images have been printed. Preferably, such images are silk screened onto cover strip 457. In addition, cover strip 457 should be made from a flexible material such as mylar.

Figure 5B:
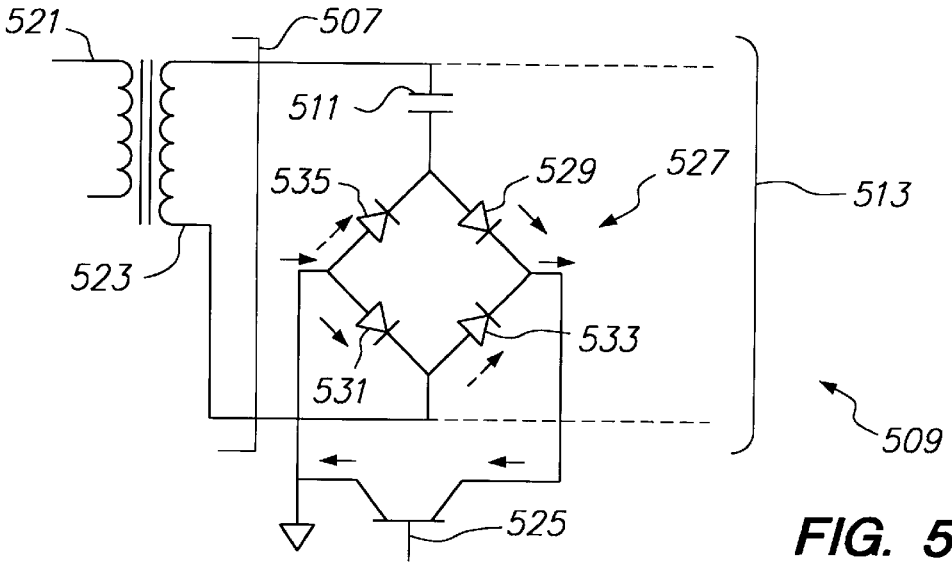
FIG. 5B is a schematic illustration of a circuit employed to switch electroluminescent elements in accordance with an embodiment of the present invention.
Figure 5A:
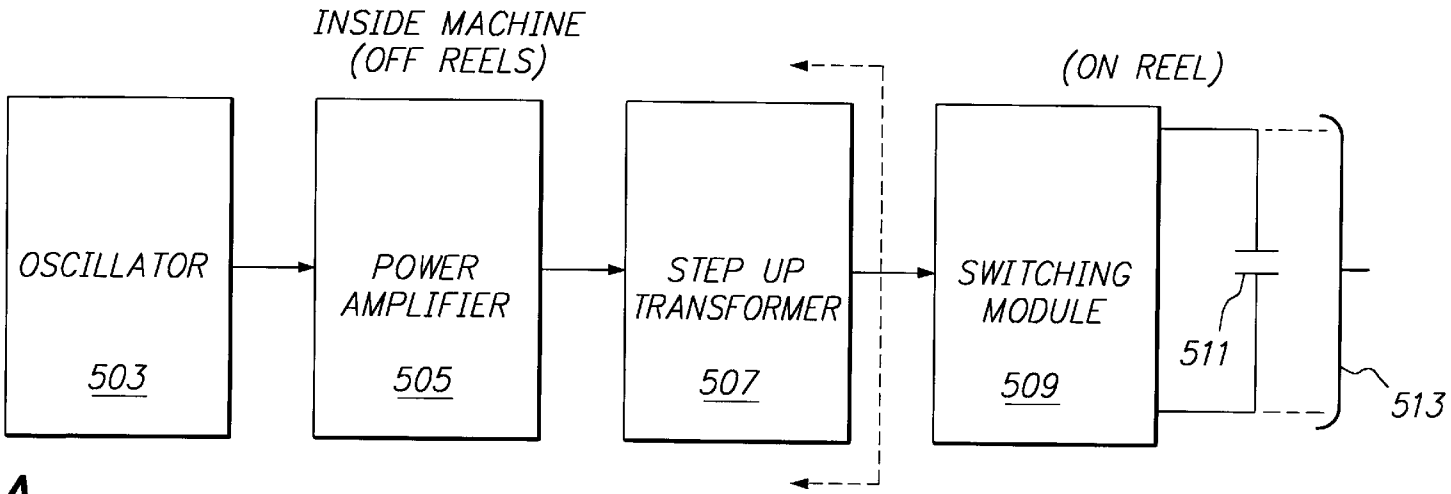
FIG. 5A is a block diagram illustrating the components of a power system for an electroluminescent reel of this invention.

FIGS. 5A and 5B depict circuitry that may be employed to power and control the electroluminescent elements provided on reel strips 301. Preferably, the circuitry is provided on the printed circuit board 309 illustrated in FIGS. 3A and 3B. Alternatively, some or all of the circuitry may be formed on reel strip 301. As indicated above, one or more integrated circuits 305 may be provided on reel strip 301. These may provide at least some of the functions required to control illumination of the individual electroluminescent elements.

FIG. 5A is a block diagram illustrating the primary circuitry modules employed to control illumination of electroluminescent elements in accordance with a preferred embodiment of this invention. A power supply 501 includes a oscillator 503 for generating a high frequency AC voltage. This oscillating voltage is required to cause the electroluminescent dielectric elements to radiate light. While most electroluminescent materials will radiate light over a wide range of frequencies, the operational frequencies should be chosen to optimize brightness without unduly reducing life span. Higher frequencies provide more intense radiation but shorten the electroluminescent element's life span. Generally, frequencies between about 30 Hz and 2500 Hz will work. Preferably, the frequency range should be about 600–900 Hz to optimize life span and brightness.

In a preferred embodiment, oscillator 503 is a Wien bridge, chosen because it provides a sinusoidal output (as opposed to a square wave or saw tooth output for example), which is relatively easy to switch and provides relatively long lamp life. The frequency of the output generated by the Wien bridge is also adjustable.

The output of oscillator 503 is amplified by a power amplifier 505. In one specific example, the output of power amp 505 is about 12V. The output of power amplifier 505 goes to a step-up transformer 507, having an output of, for example, about 120V AC RMS. That is, about 12V is provided on the primary winding of transformer 507 and about 120V is generated on the secondary winding of transformer 507. This high voltage is chosen to ensure that the voltage on any individual capacitor plate will not collapse even when all electroluminescent elements are simultaneously operating.

The 120V output of step-up transformer 507 is provided to a switching module 509 which controls delivery of power to the individual electroluminescent elements. Switching module 509 must be able to switch very high frequency signals (at least in the range of 600–900 Hz). A preferred switching module of the present invention will be described below with reference to FIG. 5B. Power delivered through switching module 509 is provided to an electroluminescent element 511 and potentially to additional electroluminescent displays 513 located downstream.

Turning now to FIG. 5B, a switching module circuit 509 is depicted in schematic format. Power to switching module 509 is delivered from a primary winding 521 of transformer 507 to a secondary winding 523 of transformer 507. Power on secondary winding 523 is provided at, for example, 120V AC at 800 Hz.

A transistor 525, which may be a bipolar transistor or FET for example, is provided to switch the electroluminescent element on and off. The on/off signals to transistor 525 are provided through a gate to that transistor. Transistor 525 forms part of a bridge employed to insure that current flows in the correct direction through transistor 525, regardless of the current direction of the AC power. Transistor 525 is designed so that current flows only in the direction shown (right to left). To insure that this is the case, a bridge 527 is provided with four diodes as illustrated. When current flows from electroluminescent element 511 into switching bridge 527, current is routed through diodes 529 and 531 and out of bridge 527. When current is flowing in the opposite direction, from bridge 527 to electroluminescent element 511, the current flows through diodes 533 and 535, before exiting bridge 527. In this manner, regardless of which direction the AC current flows, it will pass in the proper direction through switching transistor 525. Additional bridges, designed like bridge 527 may be provided for other electroluminescent elements 513 located downstream from electroluminescent element 511.

In a preferred embodiment, bridge 527 and switching transistor 525 are provided on a printed circuit board associated with a given reel (see board 309 of reel 301 in FIG. 3A). Alternatively, one or more of these items is provided on the reel strip itself. As shown in FIG. 5A, step up transformer 507 as well as power amplifier 505 and oscillator 503 are common to all reels and therefore are located inside the machine, off the reels.

Figure 6A:
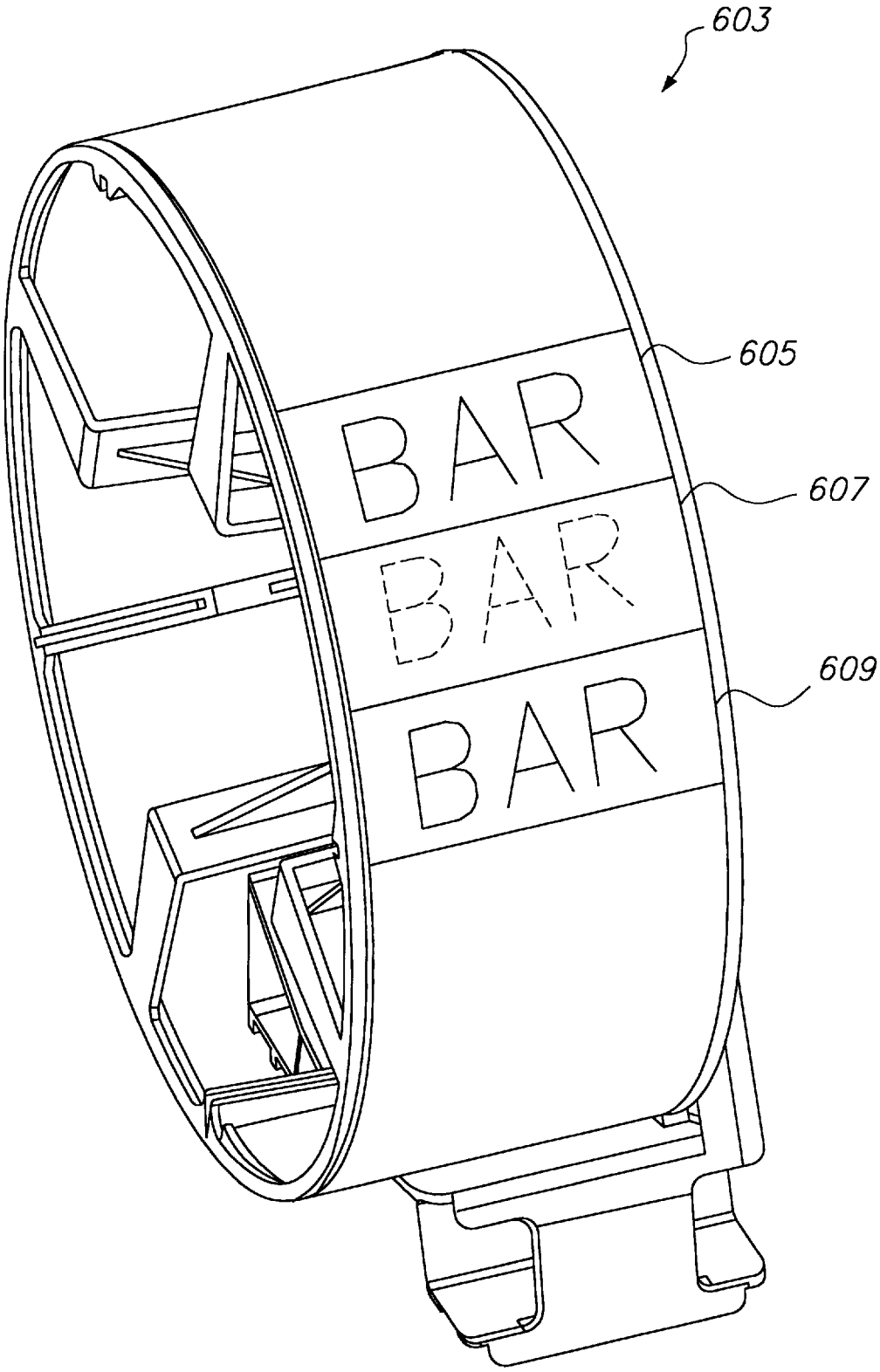
FIG. 6A is a diagram of a compound reel strip on a reel and employing selectively lit reel symbols in accordance with one embodiment of this invention.
Figure 6B:
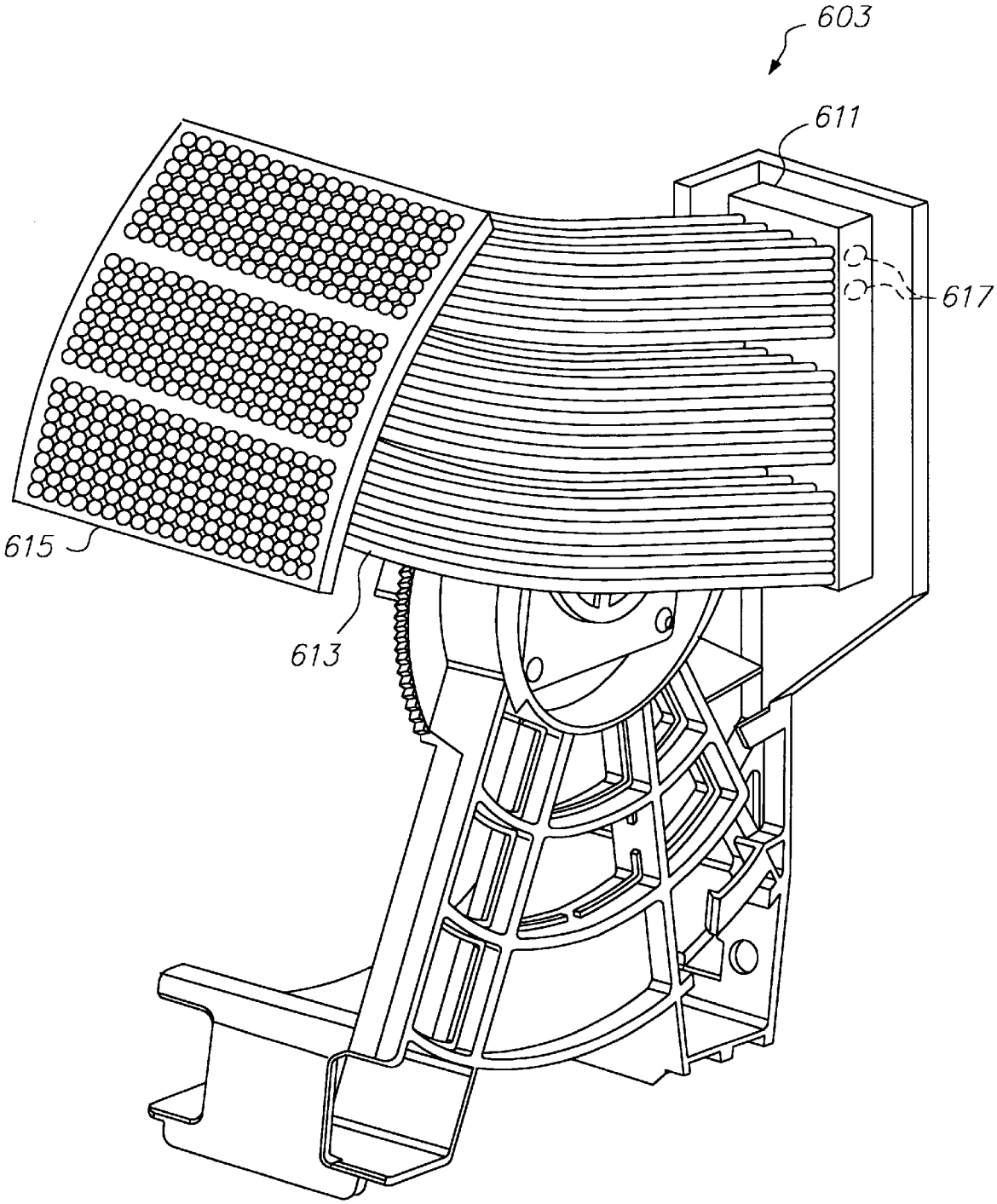
FIG. 6B is a diagram of a light diffuser assembly employed in the embodiment of FIG. 6A.

Another illuminated reel design is illustrated in FIGS. 6A–6B. This embodiment employs selectively back lighted reel symbols. The system utilizes a stepper motor reel assembly which may be similar to those utilized in conventional slot machines such as the IGT S-Plus product (available from International Game Technology of Reno, Nev.). In one specific embodiment, the physical reel strips have 22 stops, i.e., places where the reel is stopped after spinning. Eleven of the spaces (every other space) on the reel strip is a blank. Ten of the remaining 11 spaces on the reel strip are printed with compound symbols. The remaining symbol is a Jackpot symbol unique to the personality of the game. Other reel and symbol arrangements are of course possible. Importantly, compound symbols are printed on the reel strip in such a manner as to be transparent and they are also covered by a translucent covering layer. These compound symbols are not visible until lighted from behind. As illustrated in FIG. 6A, examples of a compound reel strip assembly 603 symbol might be a single bar 605, a double bar 607, and a triple bar 609. The symbol is actually printed as a triple bar symbol. However, by selectively back lighting each of the components of the triple bar symbol, it can be presented as a single, double or triple bar. Many other combinations of compound symbols are possible.

FIG. 6B illustrates one mechanism suitable for implementing a compound reel strip such as that depicted in FIG. 6A. As shown in FIG. 6B, inside the reel assembly 603 and immediately behind a viewing area corresponding to the pay line(s) is a light diffuser assembly 615. There is one light diffuser assembly per reel and it consists of terminations of a multiplicity of fiber optic bundles 613 which couple the diffuser 615 to a light source 611. The light source 611 is an array of multiple colored light elements 617 such as LEDs, incandescent lamps or other sources of high intensity light. These light source elements 617 are driven by the game processor (not shown) which controls the game outcome. The light source elements 617, the fiber optic bundles 613 and the diffuser assembly 615 are constructed in such a manner as to allow selective illumination of reel symbol elements. Thus, using the above example of a compound single, double or triple bar symbol, it would be possible to illuminate the component symbols of the compound symbol in selected colors, e.g., a red single bar, a blue triple bar a green double bar, etc. In one example, the Jackpot symbol is not a compound symbol, but it could, nevertheless, be selectively illuminated in various colors by selecting the appropriate light source elements.

Note that the game processor may control the symbol color during a player attraction mode in order to further improve a game's appeal. In addition, the processor may cause the reel to alternate between the different colors during the course of a game play as the reel spins such that the player can see the color changes.

Although the foregoing invention has been described in some detail for purposes of clarity of understanding, it will be apparent that certain changes and modifications may be practiced within the scope of the appended claims. For instance, while the luminescent displays of this invention have been described as forming part of a slot machine reel, they also may be employed in other areas of the gaming machine. For example, they may used in secondary displays such as a "Wheel of Fortune" display in which a player has the option of spinning the wheel to obtain a greater or lesser payout. The wheel may include electroluminescent sectors which are illuminated when selected.

What is claimed is:

1. A reel for a slot machine comprising:

an internal reel portion rotatable about an axis and having an outer circumferential region; and a reel strip mounted on said outer circumferential region and including (i) a plurality of symbol regions for displaying symbols to a player of said slot machine, and (ii) at least two light elements in one or more of said symbol regions, which are configured for independent illumination and viewing from substantially the same viewing angle relative the respective symbol region of the reel strip to provide at least two visibly distinct illumination patterns.

2. The reel of claim 1, wherein said at least two light elements are electroluminescent elements.

3. The reel of claim 1, wherein at least one of said symbol regions includes two or more light elements which provide illumination patterns defining two or more different symbol items.

4. The reel of claim 1, wherein at least one of said symbol regions includes one or more colored light elements which provide illumination patterns in at least two colors to indicate different symbol items.

5. The reel of claim 1, further comprising an inked image of a symbol item provided on a symbol region of said reel strip.

6. The reel of claim 5, wherein the inked symbol item is provided with one or more of said light elements on a defined symbol region, whereby when said one or more light elements are illuminated on said defined symbol region, a first symbol item appears and when said one or more light elements on said defined symbol region are not illuminated, the inked symbol item appears.

7. The reel of claim 6, wherein the defined symbol region includes one or more colored light elements which provide illumination patterns in at least two colors to indicate different symbol items.

8. The reel of claim 1, further comprising a circuit element provided on said reel strip for independently controlling the two or more light elements.

9. The reel of claim 1, further comprising a high frequency AC switch for controlling at least one of said light elements, wherein said high frequency switch includes a bridge comprising (i) a switching transistor which controls delivery of power to at least one of said light elements, and (ii) a plurality of rectifying diodes arranged to force current flowing through said switching transistor to flow in a single direction through said switching transistor regardless of which direction the alternating current flows.

10. A method of performing a game play on a gaming machine, the method comprising:

determining that a user has initiated said game play;

spinning a plurality of reels on said gaming machine;

illuminating a first light element on at least a portion of a symbol on one of said reels to provide an illumination pattern defining a first symbol item;

illuminating a second light element on at least another portion of said symbol to provide an illumination pattern defining a second symbol item, said first symbol item and said second symbol item being viewable from substantially the same viewing angle relative the respective symbol; and stopping the reels from spinning such that a combination of symbols is displayed through a display window of said gaming machine, wherein the illuminated light elements are activated on said reel.

11. The method of claim 10, wherein at least one of the illuminating the first light element and illuminating the second light element illuminates only a portion of said symbol on one of said reels.

12. The method of claim 10, wherein at least one of the illuminating the first light element and illuminating the second light element illuminates an electroluminescent lighting element provided on said symbol.

13. The method of claim 12, wherein at least one of said illuminating the first light element and illuminating the second light element comprising delivering an AC current to said electroluminescent element, said AC current having a frequency of between about 600 and 900 Hz.

14. The method of claim 10, wherein said gaming machine includes multiple pay lines, and wherein at least one of said illuminating the first light element and illuminating the second light element illuminates only those symbols displayed that comprise a winning combination.

15. The method of claim 10, wherein said game presents a winning combination which requires that at least one of said first and second light elements is lighted, and wherein a combination displaying said at least one of said first and second light elements when it is not lit does not represent a winning combination.

16. The method of claim 10, wherein each illuminated light element displays more than one color to indicate a corresponding symbol.

17. The method of claim 16, wherein the different colors alternate as the reel spins such that the player can see the color changes.

18. A reel strip for use as a display portion of a slot machine reel, said reel strip comprising:

a flexible substrate;

a first electrode formed on said substrate;

one or more electroluminescent elements formed on at least a portion of said first electrode; and a second electrode formed over at least said electroluminescent elements, wherein at least one of the first and second electrodes is transparent.

19. The reel strip of claim 18, further comprising a second substrate affixed to said second electrode.

20. The reel strip of claim 19, wherein said second substrate includes inked images of symbols.

21. The reel strip of claim 20, wherein the inked images are silk screened images.

22. The reel strip of claim 18, wherein said transparent electrode is made from indium tin oxide, or similar transparent conductive material.

23. The reel strip of claim 18, further comprising non-luminescent dielectric regions formed about said electroluminescent regions, and sandwiched between said first and second electrodes.

24. The reel strip of claim 18, further comprising one or more circuit elements controlling application of power to at least portions of said first and second electrodes.

25. The reel strip of claim 24, wherein said circuit elements comprise integrated circuits.

26. The reel strip of claim 18, wherein each electroluminescent element is capable of displaying more than one color to indicate a corresponding symbol.

27. The reel strip of claim 26, wherein the electroluminescent element is configured such that more than one color alternates as the reel spins such that the player can see the color changes.

28. A method of displaying multiple symbols in a single symbol region of a slot machine, the method comprising:

providing one or more reels, said reel or reels having a plurality of symbol regions thereupon, at least one of said symbol regions being modifiable and having a first countenance and a second countenance, said second countenance being visibly distinct from said first countenance, and said first and second countenances being configured for viewing from substantially the same viewing angle relative the respective symbol region;

displaying at least one first countenance during a first display period; and modifying at least one of said modifiable symbol regions into said second countenance during a second display period.

29. The method of claim 28, wherein one or more of said modifiable symbol regions can be modified into at least three countenances, whereby each countenance of a given symbol region is visibly distinct from every other countenance of said symbol region.

30. The method of claim 28, wherein said modifying step includes the step of selectively illuminating one or more of said modifiable symbol regions in order to effect said second countenance.

31. The method of claim 30, wherein a given countenance may be represented by a symbol region having no illumination.

32. The method of claim 28, wherein said second countenance of a modifiable symbol region carries a different payout value than the respective first countenance of said modifiable symbol region.

33. A slot machine comprising:

an exterior housing, said housing having a viewing region through which one or more internal reels are visible;

one or more internal reels rotatable about an axis, said reel or reels having a plurality of symbol regions thereupon, at least one of said symbol regions being modifiable and having a first countenance and a second countenance, said second countenance being visibly distinct from said first countenance, and said first and second countenances being configured for viewing from substantially the same viewing angle relative the respective symbol region; and one or more illuminating devices, said device or devices selectively illuminating one or more of said symbol regions, whereby controlling the one or more illuminating devices controls display of said first and second countenances.

34. The slot machine of claim 33, wherein one or more of said symbol regions can be illuminated into at least three countenances, whereby each countenance of a given symbol region is visibly distinct from every other countenance of said symbol region.

35. The slot machine of claim 33, wherein said illuminating devices are located on said reels.

36. The slot machine of claim 33, wherein said symbol regions are transparent and are covered with a translucent covering layer, whereby said symbol regions are not visible through said viewing region unless illuminated.

37. The slot machine of claim 36, wherein one or more of said illuminating devices are located behind said symbol regions, said device or devices selectively backlighting said symbol regions when lit.

38. The slot machine of claim 37, wherein one or more of said illuminating devices comprise a light diffuser assembly comprised of terminations of a multiplicity of fiber optic bundles, said bundles coupling the diffuser to a light source.

39. The slot machine of claim 33, wherein said second countenance of said illuminated symbol region carries a different payout value than the respective first countenance of said symbol region.

40. A reel for a slot machine comprising:

an internal reel portion rotatable about an axis and having an outer circumferential region;

a reel strip mounted on said outer circumferential region and including (i) a plurality of symbol regions for displaying symbols to a player of said slot machine, and (ii) one or more light elements in one or more of said symbol regions, which light elements can be illuminated independently of one another; and a circuit element provided on said reel strip for independently controlling the one or more light elements.

41. The reel of claim 40, wherein at least one of said symbol regions includes one or more colored light elements which provide illumination patterns in at least two colors to indicate different symbol items.

42. The reel of claim 40, further comprising an inked image of a symbol item provided on a symbol region of said reel strip.

43. The reel of claim 42, wherein the inked symbol item is provided with one or more of said light elements on a defined symbol region, whereby when said one or more light elements are illuminated on said defined symbol region, a first symbol item appears and when said one or more light elements on said defined symbol region are not illuminated, the inked symbol item appears.

44. A method of performing a game play on a gaming machine, the method comprising:

determining that a user has initiated said game play;

spinning a plurality of reels on said gaming machine;

illuminating an electroluminescent element provided on at least a portion of a symbol on one of said reels through an AC current having a frequency of between about 600 and 900 Hz.; and stopping the reels from spinning such that a combination of symbols is displayed through a display window of said gaming machine, wherein said illuminated light element is activated on said reel.

45. The method of claim 44, wherein said illuminating the light element illuminates only a portion of said symbol on one of said reels.

46. The method of claim 44, wherein said gaming machine includes multiple pay lines, and wherein illuminating the light element only illuminates only those symbols displayed that comprise a winning combination.

47. The method of claim 44, wherein said game presents a winning combination which requires that said light element is lighted, and wherein a combination displaying said light element when it is not lit does not represent a winning combination.

48. The method of claim 44, wherein each illuminated light element displays more than one color to indicate a corresponding symbol.

49. A reel for a slot machine comprising:

an internal reel portion rotatable about an axis and having an outer circumferential region;

a reel strip mounted on said outer circumferential region and including (i) a plurality of symbol regions for displaying symbols to a player of said slot machine, and (ii) one or more light elements in one or more of said symbol regions, which light elements can be illuminated independently of one another; and a high frequency AC switch for controlling at least one of said light elements, wherein said high frequency switch includes a bridge comprising (i) a switching transistor which controls delivery of power to at least one of said light elements, and (ii) a plurality of rectifying diodes arranged to force current flowing through said switching transistor to flow in a single direction through said switching transistor regardless of which direction the alternating current flows.

50. The reel of claim 49, wherein at least one of said symbol regions includes one or more colored light elements which provide illumination patterns in at least two colors to indicate different symbol items.

51. The reel of claim 49, further comprising an inked image of a symbol item provided on a symbol region of said reel strip.

52. The reel of claim 51, wherein the inked symbol item is provided with one or more of said light elements on a defined symbol region, whereby when said one or more light elements are illuminated on said defined symbol region, a first symbol item appears and when said one or more light elements on said defined symbol region are not illuminated, the inked symbol item appears.

53. A slot machine comprising:

an exterior housing, said housing having a viewing region through which one or more internal reels are visible;

one or more internal reels rotatable about an axis, said reel or reels having a plurality of symbol regions thereupon, at least one of said symbol regions being modifiable and having a first countenance and a second countenance, said second countenance being visibly distinct from said first countenance; and one or more illuminating devices, said device or devices including a light diffuser assembly comprised of terminations of a multiplicity of fiber optic bundles, said bundles coupling the diffuser to a light source for selectively illuminating one or more of said symbol regions, whereby controlling the one or more illuminating devices controls display of said first and second countenances.

54. The slot machine of claim 53, wherein said symbol regions are transparent and are covered with a translucent covering layer, whereby said symbol regions are not visible through said viewing region unless illuminated.

55. The slot machine of claim 54, wherein one or more of said illuminating devices are located behind said symbol regions, said device or devices selectively backlighting said symbol regions when lit.

56. The slot machine of claim 53, wherein said second countenance of said illuminated symbol region carries a different payout value than the respective first countenance of said symbol region.

57. A slot machine comprising:

an exterior housing having a viewing region;

a plurality of internal reels rotatable about an axis, each having a plurality of symbol regions thereupon wherein at least one of said symbol regions is modifiable and having a first countenance and a second countenance, said second countenance being visibly distinct from said first countenance; and at least two backlit illuminating devices configured for selective backlit illumination of the one symbol region, wherein controlling the illuminating devices controls display of the symbol region in a manner visibly distinguishing the first countenance and the second countenance.

* * * * *